US005895529A

United States Patent [19]

Foley et al.

[11] Patent Number: 5,895,529

[45] Date of Patent: Apr. 20, 1999

[54] CHUCK APPARATUS FOR SUBSTRATE SHAPING

[75] Inventors: Geoffrey M. T. Foley, Fairport; Robert W. Hedrick, Spencerport; Henry T. Mastalski; Ernest F. Matyi, both of Webster; Yonn K. Rasmussen, Fairport; Mark S. Thomas, Williamson; Huoy-Jen Yuh, Pittsford; William G. Herbert, Williamson; Gary J. Maier, Webster, all of N.Y.

[73] Assignee: Xerox Corporation, Stamford, Conn.

[21] Appl. No.: 08/878,688

[22] Filed: Jun. 19, 1997

Related U.S. Application Data

[63] Continuation of application No. 08/627,709, Mar. 29, 1996, abandoned.

[51] Int. Cl.[6] ..... B05C 3/00; B05C 19/02; B05C 13/00; B05C 13/02

[52] U.S. Cl. ..... 118/423; 118/500; 427/171; 427/430.1

[58] Field of Search ..... 118/423, 420, 118/500; 427/171, 430.1

[56] References Cited

U.S. PATENT DOCUMENTS

| | | | |
|---|---|---|---|
| 5,282,888 | 2/1994 | Fukawa et al. | 118/500 |
| 5,322,300 | 6/1994 | Mistrater et al. | 279/2.17 |
| 5,413,810 | 5/1995 | Mastalski | 427/171 |
| 5,477,780 | 12/1995 | Keller | 101/137 |
| 5,509,388 | 4/1996 | Andres | 123/231 |
| 5,720,815 | 2/1998 | Swain | 118/407 |

*Primary Examiner*—Stanley S. Silverman
*Assistant Examiner*—Jacqueline A. Ruller
*Attorney, Agent, or Firm*—Zosan S. Soong

[57] ABSTRACT

There is disclosed a chuck apparatus for holding and shaping a hollow, flexible, endless substrate during dip coating comprising: (a) a hollow, flexible bladder adapted to be disposed within the substrate; and (b) a first spindle and a second spindle which are partially disposed within the bladder, the second spindle being movable to press the bladder against the substrate and to shape the bladder and the substrate into an elongated shape.

9 Claims, 4 Drawing Sheets

CHUCK APPARATUS FOR SUBSTRATE SHAPING

This application is a continuation of application Ser. No. 08/627,709, filed Mar. 29, 1996, now abandoned.

CROSS REFERENCE TO RELATED COPENDING APPLICATION

Attention is directed to the following related application filed concurrently: Geoffrey M. T. Foley et al., "Higher Substrate Density Dip Coating Method" (U.S. Pat. No. 5,599,646), the disclosure of which is totally incorporated by reference.

BACKGROUND OF THE INVENTION

This invention relates to a dip coating method and a chuck apparatus which increase the number of substrates that can be dipped into a coating vessel at one time. The instant dip coating method and chuck apparatus are useful in the fabrication of electrostatographic imaging members.

Dip coating is a coating method involving dipping one or more substrates in a coating solution and taking up the substrates. The combination of the dipping motion of the substrates into the coating solution and the subsequent raising motion of the substrates from the coating solution constitutes one dip coating cycle. FIG. 1 illustrates the conventional method of dip coating a plurality of cylindrical substrates 2, wherein the substrates are dipped into and raised out of the coating vessel 4 containing a coating solution while the substrates are maintained in a cylindrical shape.

There is a need, which the present invention addresses, for a dip coating method and a chuck apparatus which can increase the number of substrates that can be dipped into the coating vessel at one time. Thus, the present invention enables an increase in the number of substrates per square meter of coating solution surface area.

The following documents disclose conventional dip coating methods, dip coating apparatus, and photosensitive members: Fukawa et al., U.S. Pat. No. 5,282,888; Aoki et al., U.S. Pat. No. 4,680,246; Miyake, U.S. Pat. No. 5,213,937; Dossel et al., U.S. Pat. No. 4,652,507; and Pietrzykowski, Jr. et al., U.S. Pat. No. 5,334,246, the disclosures of which are totally incorporated by reference.

SUMMARY OF THE INVENTION

The instant invention is accomplished by providing a chuck apparatus for holding and shaping a hollow, flexible, endless substrate during dip coating comprising means for holding the substrate and shaping the width of the substrate into an elongated shape.

There is also provided in embodiments a chuck apparatus for holding and shaping a hollow, flexible, endless substrate during dip coating comprising:

(a) a hollow, flexible bladder adapted to be disposed within the substrate; and (b) a first spindle and a second spindle which are partially disposed within the bladder, the second spindle being movable to press the bladder against the substrate and to shape the bladder and the substrate into an elongated shape.

BRIEF DESCRIPTION OF THE DRAWINGS

Other aspects of the present invention will become apparent as the following description proceeds and upon reference to the Figures which represent preferred embodiments.

Unless otherwise noted, the same reference numeral in the Figures refers to the same or similar feature.

DETAILED DESCRIPTION

To increase the number of substrates that can fit into a single coating vessel, the present invention shapes each substrate into a non-cylindrical shape so that the width or cross-section of the dipped non-cylindrical substrate in the coating vessel is considerably reduced in comparision with that of a cylindrical substrate. Thus, the present invention is useful where in the absence of shaping the widths of a plurality of the substrates into the elongated shape, the coating vessel is insufficient in size to accommodate the dip coating of the desired substrate batch size.

Figure 1:
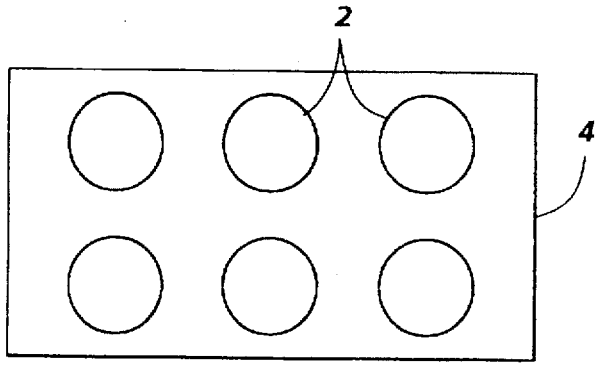
FIG. 1 PRIOR ART
FIG. 1 illustrates a schematic top view of substrates in a coating vessel which are dipped in a conventional manner.
Figure 2:
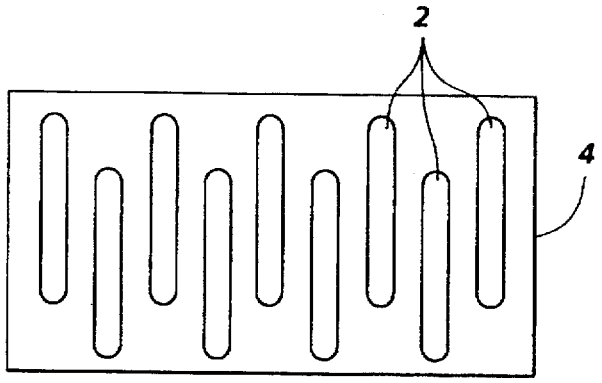
FIG. 2 illustrates a schematic top view of substrates in a coating vessel which are dipped in an inventive manner according to one embodiment of the present invention.

FIG. 2 illustrates hollow, flexible, endless substrates 2 having open ends which are vertically dipped into a single coating vessel 4 in a higher density than that achieved by the method of FIG. 1. The substrates 2 of FIG. 2 are shaped into an elongated shape and arranged into a configuration suitable for dip coating into the coating vessel 4. As used herein, the term "configuration" refers to the distribution and spacing of the plurality of the substrates. In FIG. 2, the substrates have an elongated shape which has a long dimension of straight sides. The substrates are disposed adjacent to one another in one row since the depicted coating vessel is insufficiently large to accommodate two rows of elongated substrates.

Figure 3:
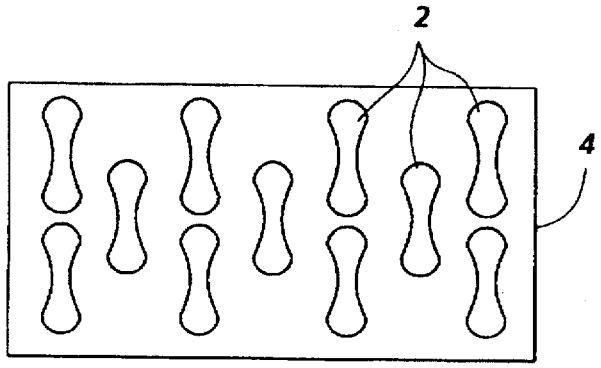
FIG. 3 illustrates a schematic top view of substrates in a coating vessel which are dipped in an inventive manner according to another embodiment of the present invention.

FIG. 3 illustrates another elongated shape where the substrates 2 are shaped into a "dog bone" shape. In FIG. 3, the substrates are arranged in a configuration to allow greater nesting where there are columns of substrates, two substrates per column, and the columns are separated by a single substrate.

The substrates may be shaped into any suitable elongated shape and arranged in any suitable configuration for dip coating. Representative elongated shapes include for example the shapes illustrated in FIGS. 2–3, an oval shape, an elliptical shape, and the like. The radius of curvature in the elongated shape preferably is not less than a certain minimum value to minimize those stresses which can adversely affect the substrate or the coated layer. This minimum value can be determined by routine experimentation. Suitable configurations include for example those illustrated herein, single row, double rows, and substrates which are positioned parallel or perpendicular to one another. The substrate batch size, i.e., the number of substrates which can fit into a single coating vessel at one time, may range for example from 2 to 50 substrates, and preferably from 6 to 20 substrates. The substrates may be spaced from one another at any suitable distance such as from about 10 mm to about 3 cm, and preferably from about 20 mm to about 1 cm (distance is measured between outer surfaces of the substrates).

The plurality of the substrates may be shaped to the desired elongated shape at any suitable time during the dip coating method. For example, the shaping may occur prior to dipping and the elongated shape is maintained during dipping of the substrates into the coating solution. Alternatively, shaping occurs while the substrates are in the coating solution and prior to raising the substrates out of coating solution. Preferably, the elongated shape of the substrates is maintained during raising of the substrates from the coating solution, whereby the coating is deposited onto the elongated substrates. The plurality of the substrates may be shaped into the same or different elongated shape and may be shaped into the desired elongated shape substantially simultaneously, and preferably simultaneously. In a preferred embodiment, the substrates are first shaped into the elongated shape and then dipped substantially simultaneously into the coating solution.

There is concern that dipping and drying the substrates in an elongated shape may cause the deposited coating, especially a thick coating which contains polycarbonate, to take a set. The term set means that the coated substrate takes on the curvature of the chuck due to the fact that the coating dried in a curved condition and therefore will not flatten out. This set may cause additional stresses in and between the deposited coating layers during subsequent use, e.g. when the coated substrate is an imaging member in an electrostatographic printing apparatus, which may decrease the life of the imaging member because these additional stresses are additive to the bending stresses encountered during use. To minimize any additional stresses, the following approaches are preferred. Subsequent to raising the substrates from the coating solution where the substrates have an elongated shape, the coated substrates may be dried while the substrates are maintained in the elongated shape and then the substrates are subjected to a stress relieving step such as being heated while in a cylindrical shape. Alternatively, subsequent to raising the substrates from the coating solution where the substrates have an elongated shape, the width of the coated substrates is changed to a cylindrical shape and the coated substrates are dried in a cylindrical shape.

Figure 4:
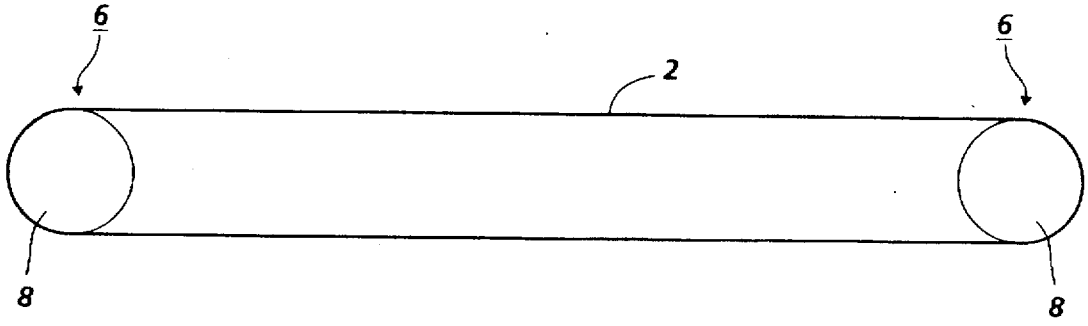
FIG. 4 illustrates a schematic top view of the inventive chuck apparatus holding and shaping a substrate.

FIG. 4 illustrates one embodiment of a chuck apparatus 6 which includes a means for holding the substrate and shaping the width of each substrate into an elongated shape. In particular, the substrate holding and shaping means includes two support spindles 8 between which the substrate 2 is stretched. The spindles allow for the dip coating of substrates of varying sizes/pitches with the same hardware.

Figure 5:
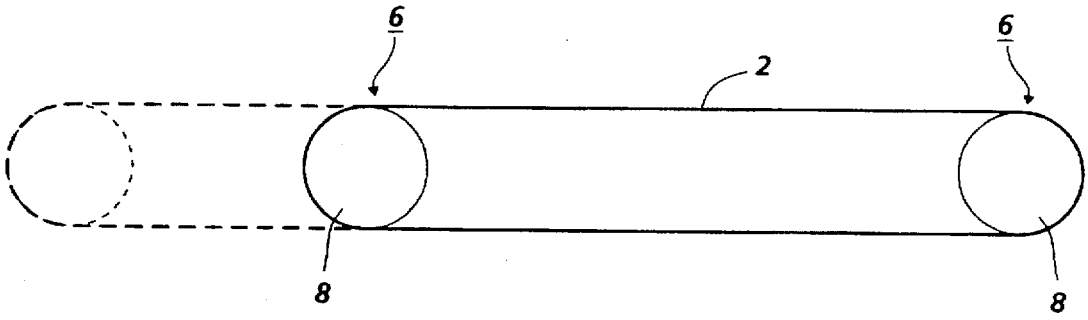
FIG. 5 illustrates a schematic top view of the inventive chuck apparatus holding and shaping a substrate, wherein a part of the chuck apparatus is capable of linear, translational motion.

In FIG. 5, one spindle 8 is immobile and the other spindle 8 is movable in the direction of substrate elongation. Thus, the substrate 2 can be held and shaped by the linear, translational motion of one of the spindles, the linear motion being commensurate with the size/pitch of the substrate to be dip coated. In embodiments of the present invention, both spindles may be movable, preferably capable of linear, translational motion.

Figure 6:
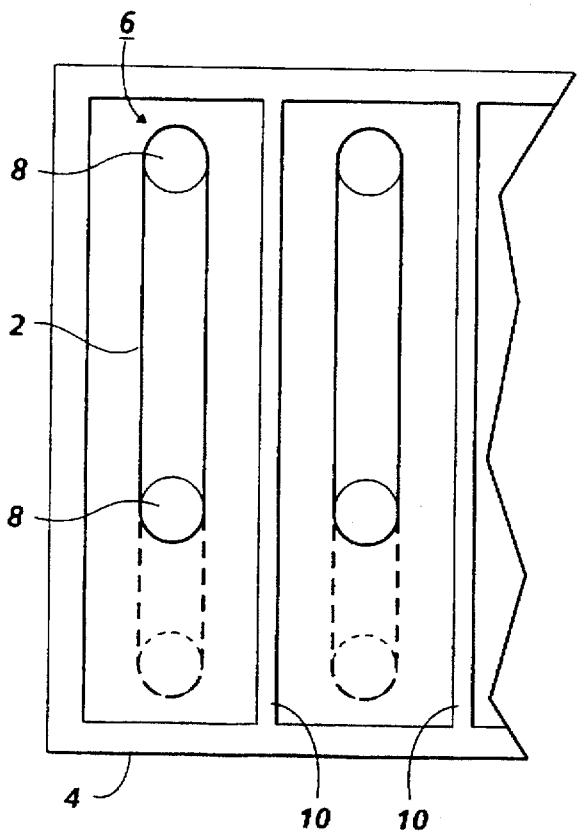
FIG. 6 illustrates a schematic top view of a plurality of the inventive chuck apparatus holding and shaping substrates in a coating vessel, wherein a part of each chuck apparatus is capable of linear, translational motion.

In FIG. 6, the coating vessel 4 including partitions 10 is compatible with a range of substrate sizes/pitches, especially by using for example the two spindles 8 to hold and shape the substrates 2.

Figure 7:
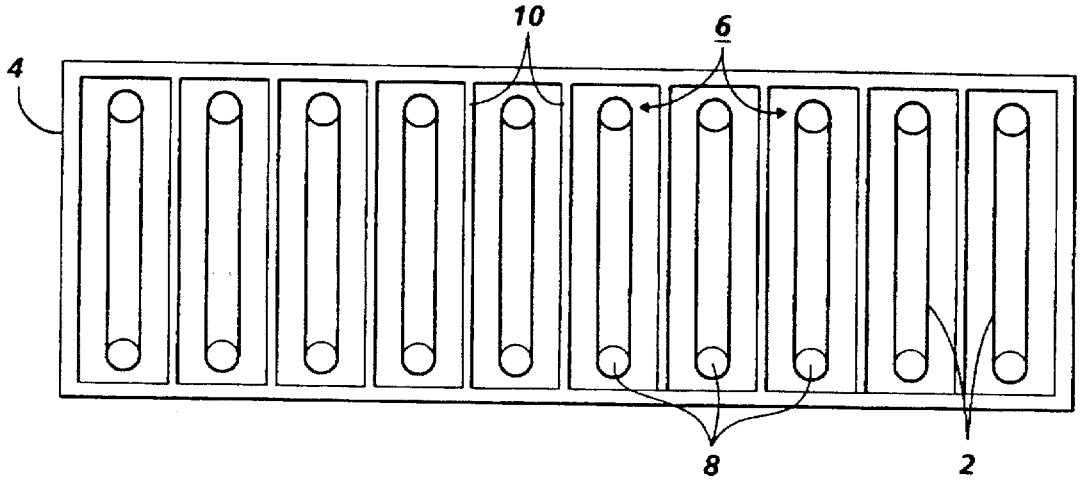
FIG. 7 illustrates a schematic top view of substrates in a coating vessel which are dipped in an inventive manner according to still another embodiment of the present invention, wherein the substrates are held and shaped by a plurality of the inventive chuck apparatus.

FIG. 7 illustrates a plurality of substrates 2 disposed in a single coating vessel 4 containing partitions 10, wherein each substrate is held and shaped by a pair of spindles 8.

Each spindle may be fabricated of any suitable material such as a metal like steel or aluminum, or a plastic. Preferably, each spindle includes a relatively high friction material on its surface such as rubber to improve the frictional contact between the spindle and the inner surface of the substrate.

Figure 8:
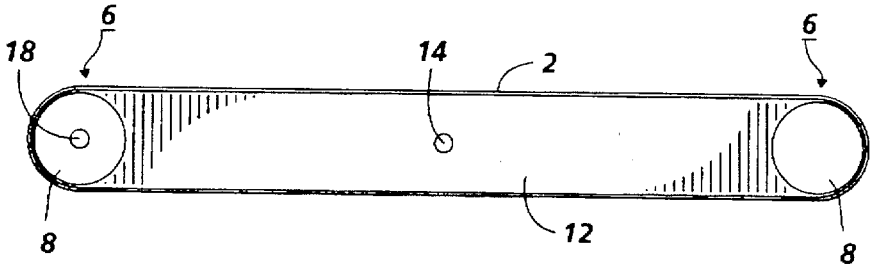
FIG. 8 illustrates a schematic top view of another embodiment of the inventive chuck apparatus holding and shaping a substrate.
Figure 9:
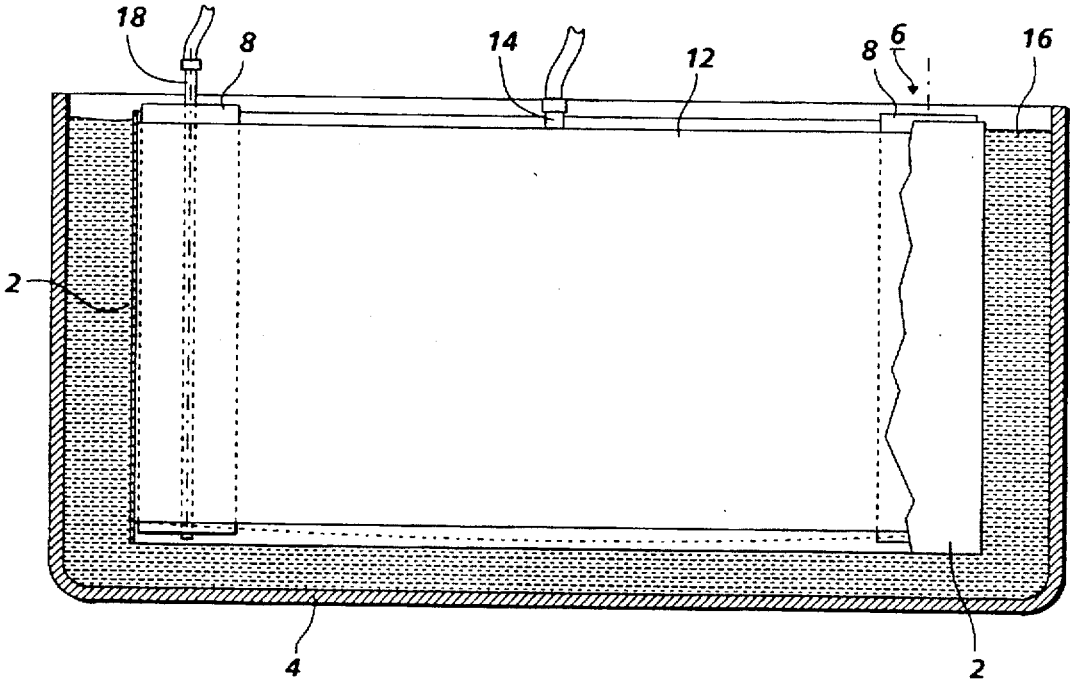
FIG. 9 illustrates a schematic, cross-sectional side view of a preferred chuck apparatus holding and shaping a substrate in the coating vessel.

FIGS. 8–9 illustrate a preferred chuck apparatus 6 which minimizes or eliminates contact of the coating solution 16 with the inside of the substrate 2 during dip coating. The substrate holding and shaping means is in the form of two spindles 8. A flexible bladder 12, made from for example rubber, is stretched over the spindles, preferably to form an air tight cavity. The bladder has openings in the top and bottom to accommodate the spindles. A gas inlet 14 to the bladder 12 is optionally provided at the top of the bladder. The substrate 2 is tensioned between the spindles 8 and the bladder 12, preferably prior to lowering of the substrate into the coating vessel 4. One or both spindles may be capable of linear, translational motion to tension the substrate. The tensioning of the substrate causes it to conform to the bladder so as to form a liquid-tight seal. Formation of a good seal may be assisted in two ways beyond the simple act of tensioning the substrate. The first seal enhancement method involves pressurizing of the inside of the bladder with a gas such as air via the gas inlet to force the bladder against the substrate. The second seal enhancement method involves placing one, two, three, or more magnets such as strip magnets (not shown) inside the bladder around the perimeter at the bottom of the bladder where the seal is to be made. The magnets are attracted to the substrate (assuming the substrate can attract a magnet), thereby forcing the bladder against substrate and improving the quality of the seal.

When the substrate is lowered into the coating vessel, the coating solution may begin to rise inside the substrate as the trapped air is compressed. The upward creep of the coating solution can be managed in several ways. First, inflation of the bladder via the gas inlet as the substrate is lowered so as to displace some of the trapped air may tend to maintain the liquid level constant at the bottom of the substrate. Second, provision of a gas conduit 18 through a spindle permits the injection of a gas such as air into the air space between the bladder 12 and the coating solution 16 so as to appropriately compensate for the compression of the trapped air as the substrate is submerged. Third, the level of the coating solution inside the substrate is permitted to rise as the substrate is submerged. The substrate width is so chosen that when the final coating is applied and dried, the edge of the substrate with the coated interior is then cut off.

In embodiments of the present invention, the chuck apparatus 6 illustrated in FIGS. 8–9 can shape the substrate into an oval shape for dip coating. When it is desired to change the width of the substrate into a cylindrical shape such as for drying or as a stress relieving step as discussed herein, the cylindrical shape can be achieved by for example moving the spindles toward one another to distance them away from the bladder inner surface, and then inflating the bladder with a gas to shape it into the cylindrical shape and to press the bladder against the substrate, thereby also shaping the substrate into the cylindrical shape.

Where the substrate is fabricated from a metal such as nickel, the substrate is optionally formed by for example electroforming, with a closed bottom end so as to permit dip coating of the substrate without coating of the inside of the substrate. The closed end of the substrate may be removed by laser cutting or mechanical methods following completion of all dip coating steps.

The substrate can be formulated entirely of an electrically conductive material, or it can be an insulating material having an electrically conductive surface. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include metals like copper, brass, nickel, zinc, chromium, stainless steel; and conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the photoconductive member. Generally, the conductive layer ranges in thickness of from about 50 Angstroms to 10 centimeters, although the thickness can be outside of this range. For a flexible electrophotographic imaging member, the substrate thickness typically is from about 0.015 mm to about 0.15 mm. The substrate can be fabricated from any other conventional material, including organic and inorganic materials. Typical substrate materials include insulating non-conducting materials such as various resins known for this purpose including polycarbonates, polyamides, polyurethanes, paper, glass, plastic, polyesters such as MYLAR® (available from DuPont) or MELINEX 447® (available from ICI Americas, Inc.), and the like. If desired, a conductive substrate can be coated onto an insulating material. In addition, the substrate can comprise a metallized plastic, such as titanized or aluminized MYLAR®. The coated or uncoated substrate is preferably flexible, and can have any number of configurations such as a cylindrical drum, an endless flexible belt, and the like.

The substrate may be bare of layered material or may be coated with a layered material such as that disclosed herein prior to dipping of the substrate into the coating solution. The coating solution may comprise components for deposition of any layered material typically employed in a photosensitive member including the components for the following: a charge generating material, a charge transport material, a subbing layer, a barrier layer, an adhesive layer, and an overcoat layer.

In particular, the coating solution may comprise components for the charge transport layer and/or the charge generating layer, such components and amounts thereof being illustrated for instance in U.S. Pat. Nos. 4,265,990, 4,390,611, 4,551,404, 4,588,667, 4,596,754, and U.S. Pat. No. 4,797,337, the disclosures of which are totally incorporated by reference. In embodiments, the coating solution may be formed by dispersing a charge generating material selected from azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, and the like; quinacridone pigments; or azulene compounds in a binder resin such as polyester, polystyrene, polyvinyl butyral, polyvinyl pyrrolidone, methyl cellulose, polyacrylates, cellulose esters, and the like. In embodiments, the coating solution may be formed by dissolving a charge transport material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds in a resin having a film-forming property. Such resins may include polycarbonate, polymethacrylates, polyarylate, polystyrene, polyester, polysulfone, styrene-acrylonitrile copolymer, styrene-methyl methacrylate copolymer, and the like.

Other modifications of the present invention may occur to those skilled in the art based upon a reading of the present disclosure and these modifications are intended to be included within the scope of the present invention.

We claim:

1. An apparatus for coating a batch of hollow, flexible, endless substrates having a width and a length, comprising:

(a) a coating vessel; and (b) means for holding the batch of the substrates within the coating vessel and shaping the width of the substrates into an elongated, non-cylindrical shape along the entire length of the substrates wherein the means comprises a plurality of spindle pairs wherein each spindle pair is coupled to one substrate.

2. The apparatus of claim 1, wherein one spindle of each of the spindle pairs is movable in the direction of substrate elongation.

3. The apparatus of claim 1, wherein the means comprises a plurality of hollow, flexible bladders, wherein each spindle pair is partially disposed in one bladder.

4. An apparatus for coating a hollow, flexible, endless substrate, comprising:

(a) a coating vessel;

(b) a hollow, flexible bladder disposed within the substrate; and (c) a first spindle and a second spindle which are partially disposed within the bladder, the second spindle being movable to press the bladder against the substrate and to shape the bladder and the substrate into an elongated, non-cylindrical shape.

5. The apparatus of claim 4, wherein the first spindle is immobile.

6. The apparatus of claim 4, wherein the first spindle is movable.

7. The apparatus of claim 4, wherein the first spindle and the second spindle are movable towards each other.

8. The apparatus of claim 4, wherein the bladder presses against the substrate to form a seal against contact of a coating solution with the inner surface of the substrate.

9. The apparatus of claim 4, wherein the bladder includes a gas inlet to permit inflation of the bladder with a gas.

* * * * *